US006040564A

United States Patent [19]

Ueda et al.

[11] Patent Number: 6,040,564

[45] Date of Patent: Mar. 21, 2000

[54] MICROWAVE HEATING APPARATUS AND MICROWAVE HEATING METHOD

[75] Inventors: Shigeki Ueda; Ikuhiro Inada, both of Yamatokoriyama; Satomi Uchiyama, Nara, all of Japan

[73] Assignee: Matsushita Electric Indutrial Co., Ltd., Osaka, Japan

[21] Appl. No.: 09/051,254

[22] PCT Filed: Oct. 2, 1996

[86] PCT No.: PCT/JP96/02868

§ 371 Date: Sep. 17, 1998

§ 102(e) Date: Sep. 17, 1998

[87] PCT Pub. No.: WO97/13102

PCT Pub. Date: Apr. 10, 1997

[30] Foreign Application Priority Data

Oct. 4, 1995 [JP] Japan ..... 7-257376

[51] Int. Cl.[7] ..... H05B 6/80

[52] U.S. Cl. ..... 219/682; 219/756; 219/759; 219/401; 99/451

[58] Field of Search ..... 219/682, 685, 219/683, 759, 756, 401, 400; 99/451, 468, 473, 474

[56] References Cited

FOREIGN PATENT DOCUMENTS

| | | |
|---|---|---|
| 4-2609 | 1/1974 | Japan . |
| 52-32032 | 3/1977 | Japan . |
| 53-78654 | 6/1978 | Japan . |
| 53-135045 | 11/1978 | Japan . |
| 55-67917 | 5/1980 | Japan . |
| 57-116001 | 7/1982 | Japan . |
| 4-123790 | 4/1992 | Japan . |
| 6-249445 | 9/1994 | Japan . |
| 6-272866 | 9/1994 | Japan . |
| 7-158858 | 6/1995 | Japan . |

OTHER PUBLICATIONS

Japanese language search report for Int'l Appln. No. PCT/JP96/02868 dated Jan. 8, 1997.

English translation of Japanese language search report.

*Primary Examiner*—Philip H. Leung
*Attorney, Agent, or Firm*—Ratner & Prestia

[57] ABSTRACT

The invention is intended to heat a food or other object to be heated favorably by means of microwaves while enclosing the food with superheated steam. To achieve this purpose, the apparatus comprises a heating chamber in which an object to be heated is put, steam generating means for supplying superheated steam to the heating chamber, superheated steam maintaining means provided in the heating chamber to prevent the temperature of the superheated steam from lowering, and microwave generating means for irradiating the object with microwaves, whereby the object placed in the heating chamber is heated in superheated steam with microwaves, so that the food is efficiently heated from inside and outside and the food is not wetted.

36 Claims, 5 Drawing Sheets

MICROWAVE HEATING APPARATUS AND MICROWAVE HEATING METHOD

This application is a U.S. national phase application of PCT international application PCT/JP96/02868.

TECHNICAL FIELD OF THE INVENTION

The present invention relates to a heating apparatus using microwaves for heating various objects such as foods promptly while maintaining a favorable quality.

BACKGROUND ART

Hitherto, as a heating apparatus of this type, for example, the food thawing cooking oven as disclosed in Japanese Patent Publication No. 55-51541 has been known. FIG. 5 shows its constitution, in which an agitator 3 is provided in a ceiling 2 of an oven 1 which can be enclosed tightly, and a magnetron irradiation unit 4 is disposed nearby. A detachable food rack 5 is provided in the oven 1, a liquid pan 6 for feeding water or oil is disposed beneath, and a heater 7 by gas or electric heating is disposed further beneath. By the combination of magnetron irradiation unit 4, liquid pan 6, and heater 7, both heating by magnetron irradiation from above and steam heating by boiling water from beneath can be combined.

When heating the food by such constitution, combination of internal heating by magnetron irradiation and steam heating by steam can be selected corresponding to the cooking menu. Besides, since steam is generated, as described therein, it can be applied in thawing of frozen bread and frozen cake, or as bread and cake cooker in whole process of fermentation and baking.

In such conventional heating apparatus, however, when water is contained in the liquid pan, the steam will not exceed the boiling point (100° C. at atmospheric pressure), and it is the steam below the saturation temperature that is supplied into the heating chamber. Such steam damps the food surface. In particular, when the food is frozen, an extreme dew condensation occurs on the food surface in unthawed state. Accordingly, when frozen bread or the like is thawed, drying of the food is prevented, but the crust which is desired to be crisp becomes wet and sticky, and the touch is significantly spoiled.

DISCLOSURE OF THE INVENTION

The invention is intended to solve the problems of the prior art, and it is a first object thereof to enclose the object to be heated such as food with superheated steam, and heat various objects favorably by microwaves.

It is a second object to realize a system capable of generating such superheated steam It is a third object of the invention to realize a constitution capable of maintaining the superheated steam so that the generated superheated steam may not be cooled under the saturation temperature in the heating chamber.

It is a fourth object of the invention to realize a constitution capable of heating the object by effectively utilizing the superheated steam.

To achieve the first object, the invention comprises a heating chamber for accommodating the object to be heated, steam generating means for supplying superheated steam to the heating chamber, superheated steam maintaining means provided in the heating chamber to prevent the temperature of the superheated steam from lowering, and microwave generating means for irradiating the object with microwaves. Depending on the type of the object, either the superheated steam or the saturated vapor is changed over and supplied into the heating chamber. Also depending on the type of the object, the superheated steam or the vapor below the saturation temperature is changed over during heating, and is supplied into the heating chamber. Moreover, depending on the type of the object, it is designed to dry by using the superheated steam at least in a certain period during heating.

To achieve the second object, the steam generating means of the invention includes a heat source exceeding the saturation temperature, and water is dropped thereon.

To achieve the third object of the invention, as the superheated steam maintaining means, a partition wall made of porous material such as ceramic capable of absorbing moisture is provided in the heating chamber. Or, the superheated steam maintaining means is a partition wall containing fibers such as paper or cloth capable of absorbing moisture. Besides, the superheated steam maintaining means is formed of a partition wall composed of a water repellent dielectric material. Further, the superheated steam maintaining means is a partition wall coated or molded with radio wave absorbing material such as ferrite for generating heat by absorbing microwaves. Yet, the superheated steam maintaining means is composed of an electric heat source provided in the heating chamber.

To achieve the fourth object of the invention, the superheated steam maintaining means is disposed at least on the top of the heating chamber. Or the superheated steam maintaining means is provided at least at the lower side of the heating chamber, and the object of heating is directly put on the superheated steam maintaining means. Or, as the superheated steam maintaining means, detachably formed partition walls are provided at plural positions in the heating chamber, and it is constituted so as to be capable of adjusting the position depending on the type, size or quantity of the object of heating. Further, by disposing the superheated steam maintaining means at least at the lower side of the heating chamber, and forming penetration holes, the superheated steam supplied from the steam generating means is supplied beneath the superheated steam maintaining means, and the object is put above the superheated steam maintaining means.

According to the first constitution, the invention can heat the object put in the heating chamber while emitting microwaves in the superheated steam, and can heat the object efficiently from inside and outside without moistening the surface. Depending on the type of the object of heating, either the superheated steam or the saturated vapor is changed over and used, or the superheated steam and the vapor under saturation temperature are changed over and used during heating, so that optimum heating suited to the object of heating can be done efficiently. In addition, by using the superheated steam at least in a certain period during heating, the object of heating can be dried intentionally.

According to the second constitution of the invention, the superheated steam can be generated easily.

According to the third constitution of the invention, the superheated steam is maintained in its state so that the superheated steam supplied in the heating chamber may not be lowered below the saturation temperature. Moreover, a partition wall made of porous body such as ceramic or containing fibers such as paper or cloth capable of absorbing part of superheated steam prevents dew condensation of the steam on the wall surface, and absorbed moisture is re-evaporated by microwaves, thereby preventing lowering of steam volume and temperature in the heating chamber. Or the partition wall composed of a water repellent dielectric material does not absorb superheated steam, but absorbs microwaves to raise temperature, so that the hot plate effect is exhibited to prevent lowering of temperature of the superheated steam. Further, the partition wall coated or molded with radio wave absorbing material such as ferrite, or the electric heat source provided in the heating chamber will similarly exhibit the hot plate effect to prevent lowering of temperature of the superheated steam.

According to the fourth constitution of the invention, the superheated steam can be effectively utilized according to the object of heating. The superheated steam maintaining means disposed at least on the top of the heating chamber prevents dew condensation of the superheated steam guided into the heating chamber on the ceiling, and drop onto the object, thereby preventing the quality of the object of heating from being lowered. Or the superheated steam maintaining means provided at least at the lower side of the heating chamber conducts the absorbed heat energy effectively to the object of heating as the hot plate, by putting the object of heating directly on the superheated steam maintaining means, and thereby improves uneven heating due to the presence of stationary wave intrinsic to the microwaves. Still more, by detachably forming the superheated seam maintaining means at proper positions in the heating chamber depending on the object of heating, the space filled with superheated steam is variable, and heating is efficiently done in a short time. Moreover, the superheated steam maintaining means having penetration holes provided at the lower side of the heating chamber adds heat to re-evaporate when the guided superheated steam passes through the penetration holes, thereby returning to the superheated steam.

Figure 1:
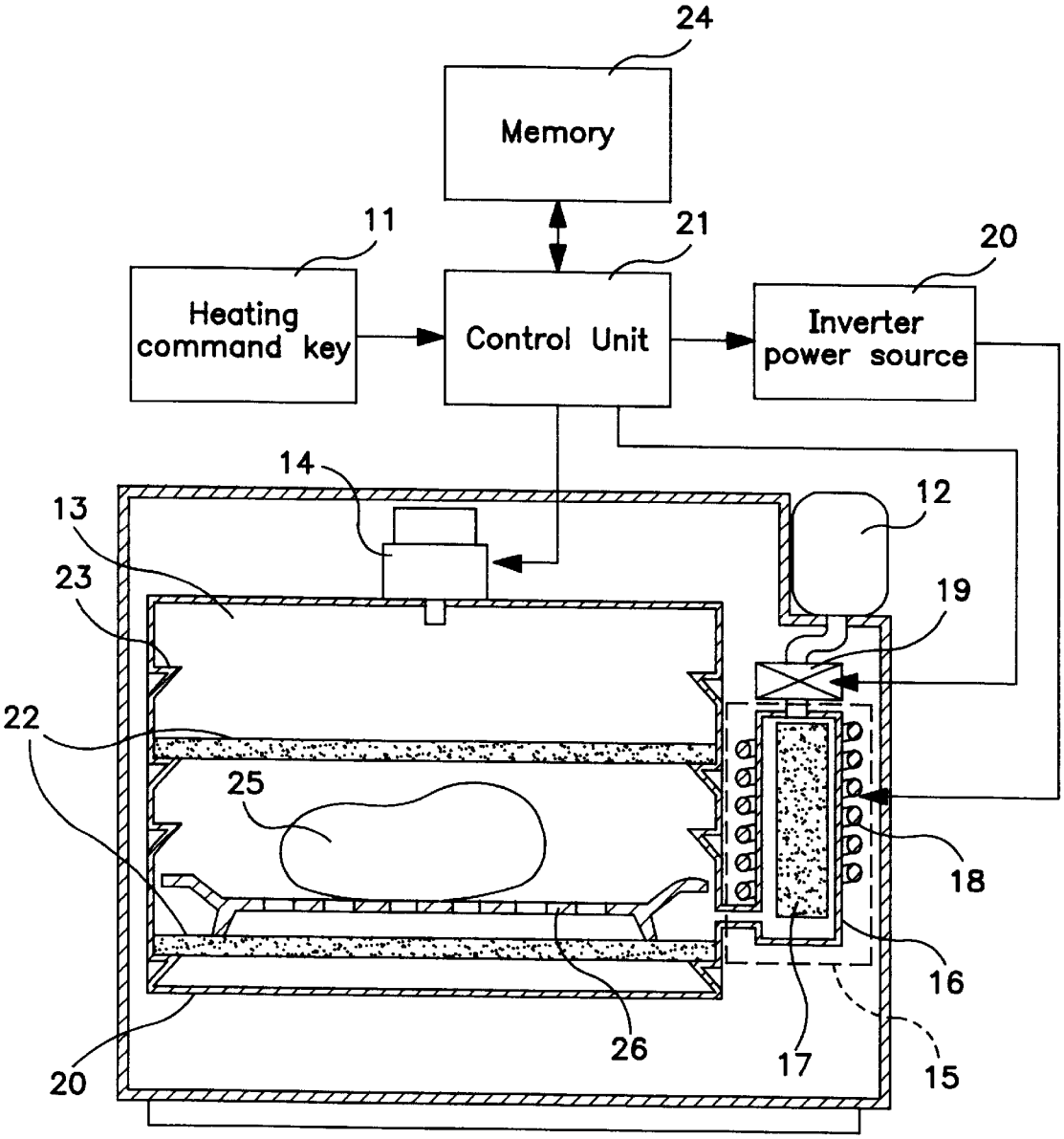
FIG. 1 is a front sectional view of a heating chamber showing an embodiment of the invention.

BEST MODES FOR CARRYING OUT THE INVENTION (Embodiment 1)

A first embodiment of the invention is described below while referring to the drawings.

Figure 2:
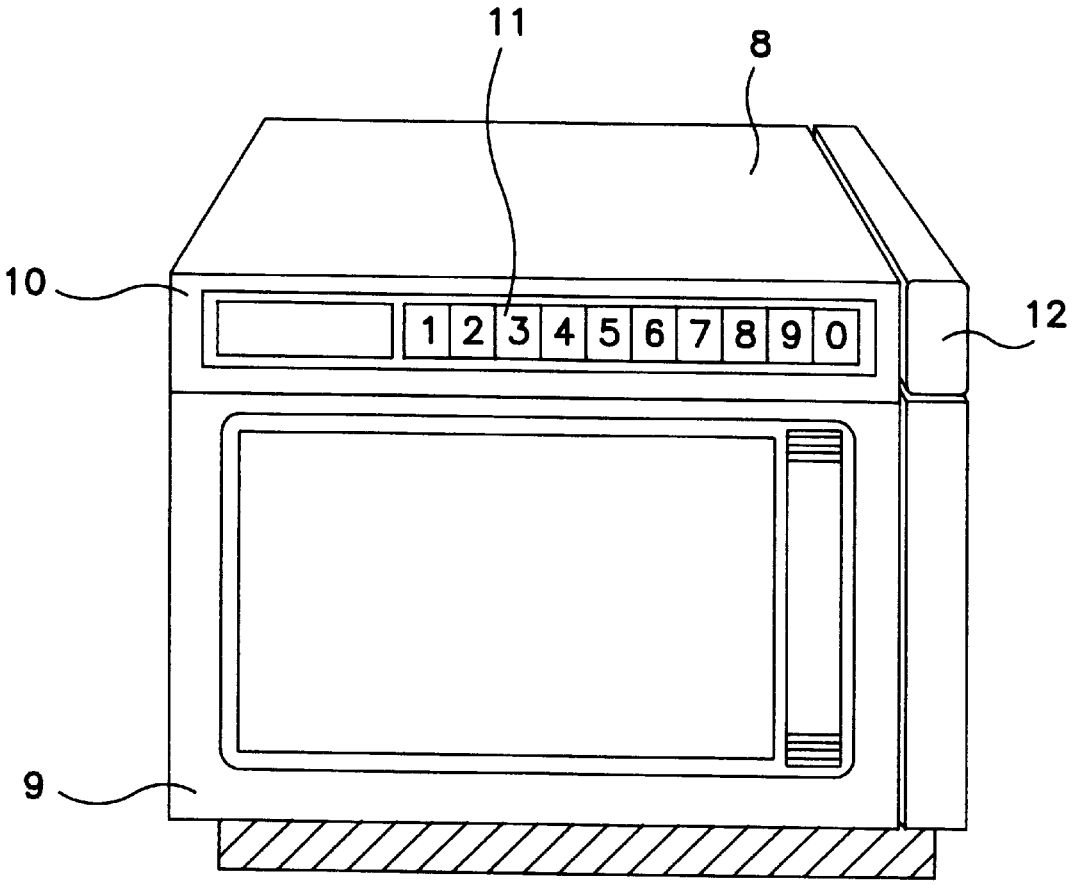
FIG. 2 is an appearance view of a heating apparatus showing an embodiment of the invention.

FIG. 2 is an appearance view of a microwave heating apparatus according to the invention. A door body 9 is supported at the front side of a main body 8 for closing the opening of the heating chamber in which the food is contained. A heating command key 11 is disposed on an operation panel 10, and codes entered in one digit or several digits correspond to the factors having effects on the heating method, such as the type or amount of food, storing temperature (frozen or chilled), heating end temperature and others, and they are commanded to the control unit described later. At the right side of the main body, a feed water tank 12 is detachably disposed.

FIG. 1 is a front sectional view of a heating chamber showing a first embodiment of the invention, in which a heating chamber 13 is coupled with a magnetron 14 as microwave generating means for emitting microwaves, and a steam generator 15 for generating steam.

The steam generator 15 comprises a boiler 16 made of heat resistant glass, ceramic or other nonmagnetic material, a ferromagnetic porous heater 17 incorporated therein, and an inverter coil 18 for feeding power thereto from outside of the boiler without making contact. Water is dropped into the boiler 16 from the feed water tank 12 through a feed water pump 19. In the inverter coil 18, a voltage of high frequency is supplied from an inverter power source 20, and the ferromagnetic porous heater 17 is heated directly by induction heating, and therefore the temperature is promptly raised over 100° C. without loss for heat conduction. The temperature and feed water volume are freely controlled by a control unit 21, so that superheated steam may be generated easily.

When the superheated steam is supplied into the heating chamber, if the heating chamber is cool, the steam temperature drops suddenly to be lower than the saturation temperature. It is very difficult to maintain the superheated steam within the heating chamber. In the invention, therefore, heating partition walls 22 are disposed as superheated steam maintaining means at upper and lower side of the heating chamber 13. This is a constitution for raising the temperature or re-evaporating, being disposed detachably on side wall rails 23, for preventing the superheated steam supplied in the heating chamber from becoming lower than the saturation temperature. The specific constitution of the superheated steam maintaining means is realized by several embodiments.

First is explained an embodiment of forming the superheated steam maintaining means by using a partition wall made of porous material such as ceramic capable of absorbing moisture. By using an unglazed thick plate as the heating partition wall, part of the superheated steam guided into the heating chamber is absorbed in it. It is then heated again and re-evaporated by microwaves. At this time, in this constitution, the steam in the ceramic is suddenly expanded, the internal pressure hikes, and the boiling point exceeds 100° C. If, for instance, dew is condensed on the heating partition wall surface, it can be returned to the superheated steam. Thus, by applying the glaze on the heating partition wall at the side not facing the object of heating, that is, at the ceiling side and floor side, the re-evaporated superheated steam blows out only to the heating object side, and the steam can be utilized without loss. It is also advantageous for raising the internal pressure.

Next is explained an embodiment of forming the superheated steam maintaining means by a partition wall containing fibers such as paper and cloth capable of absorbing moisture. In this constitution, same as above, part of the superheated steam guided into the heating chamber is absorbed, and is heated again and re-evaporated by microwaves. Although the internal pressure is not raised as in ceramics, the steam can be absorbed efficiently, and drop of dew condensation water from the ceiling onto the object of heating can be prevented securely.

Moreover, the superheated steam maintaining means may be composed of water repellent dielectric material, for example, a partition wall made of crystallized glass or ceramics coated with glaze on both sides. Although the steam is not absorbed and re-evaporated, it is heated by microwaves to be a hot plate, which heats the superheated steam guided into the heating chamber.

Alternatively, the superheated steam maintaining means may be formed by a partition wall coated or molded with a radio wave absorbing material such as ferrite for generating heat by absorbing microwaves. Although not absorbing and re-evaporating the steam, it is efficiently heated by microwaves to be hot plate, which heats the superheated steam guided into the heating chamber. Besides, since it absorbs microwaves considerably, it is effective to lessen uneven heating by reducing the microwaves reaching up to the object of heating.

Finally is shown an example of forming the superheated steam maintaining means by an electric heat source provided in the heating chamber. This is to apply the invention in the heating apparatus known as the oven range, and it is intended to heat the superheated steam by the electric heat source disposed in the heating chamber.

The control unit 21 interprets the heating command code entered from the heating command key 11, and reads out the specified heating condition from a memory 24. As the heating condition, the control data of the steam generator 15, that is, input control data to the inverter coil 18, and data showing feed water volume control to the feed water pump 19, and the data showing the current feed condition to the magnetron 14 are stored. These data may be either control values such as time series data of each block, or numerical expressions. In the case of a numerical expression, the control unit 21 calculates it to obtain time series data, and according to the obtained time series data, by input control to the inverter coil 18, feed water volume control to the feed water pump 19, and current feed control to the magnetron 14, the temperature and volume of the superheated steam fed into the heating chamber 13 and the food temperature are controlled to be predetermined values.

The object to be heated 25 is put on a tray 26 having penetration holes. The tray 26 has legs so as not to contact with the lower heating partition wall 22. The upper heating partition wall 22 may be disposed freely at three positions in the illustrated example by means of plural side wall rails 23. In such constitution, by disposing the upper heating partition wall 22 at optimum position depending on the type or shape of the object, the space to be filled with superheated steam can be set smaller, so that the object 25 can be heated more efficiently.

Figure 3A:
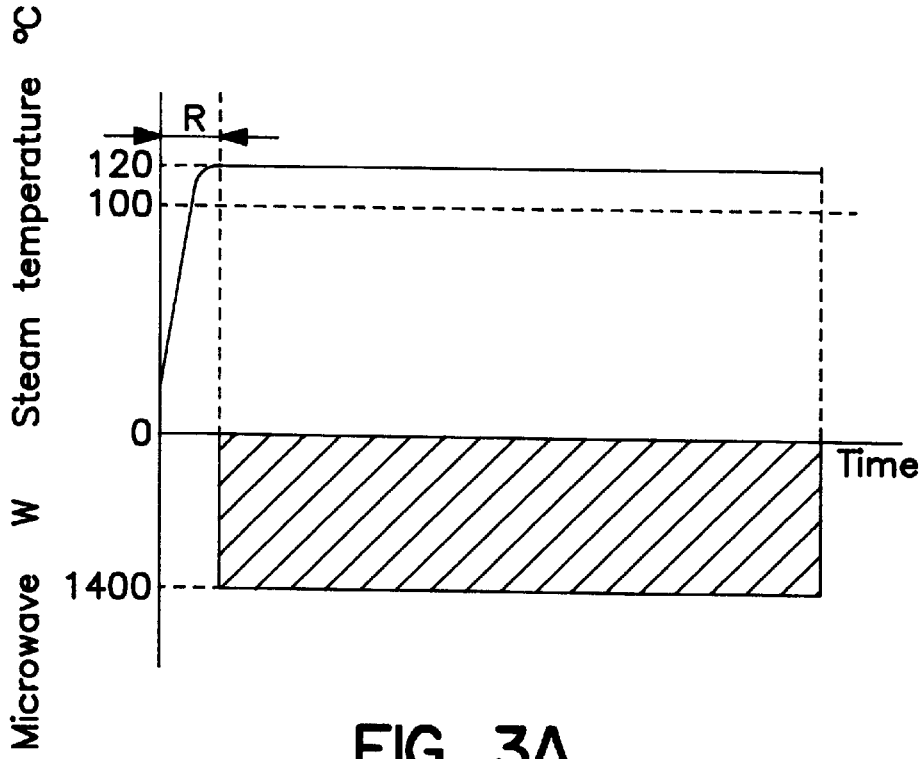
FIGS. 3 (*a*) is a diagram showing an embodiment of heating sequence of the invention, and (*b*) is a diagram showing other embodiment of heating sequence.
Figure 3B:
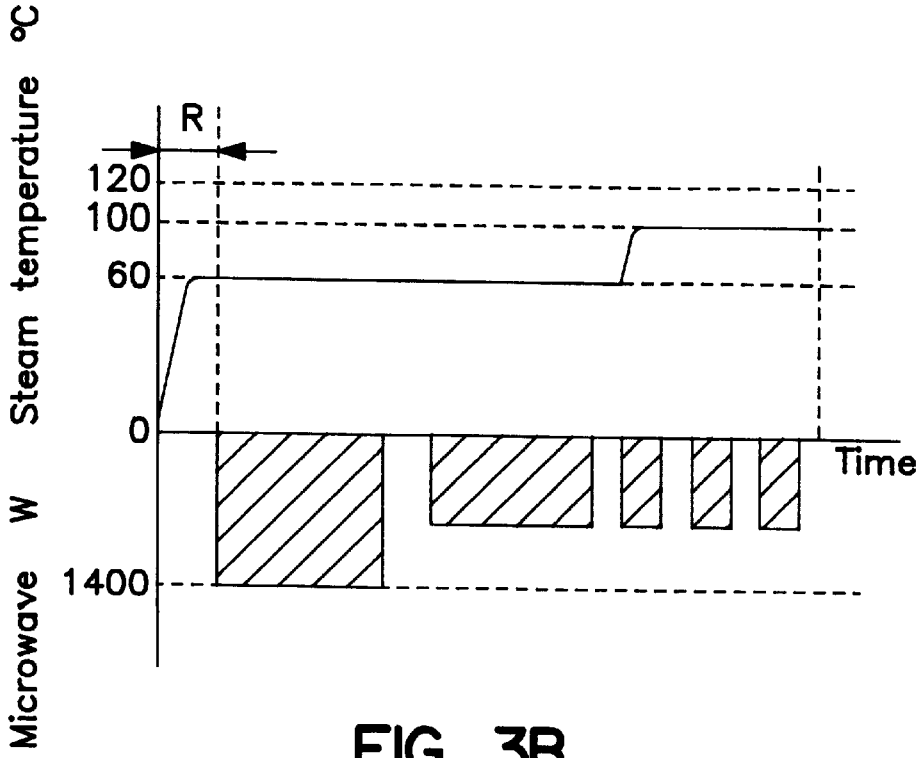

FIG. 3 is a diagram showing the temperature of superheated steam in the heating chamber and the supply state of microwaves in the heating process of the invention. In (a), emission of microwaves is stopped in the rise period R until the heating chamber reaches 120° C. This is particularly effective in warming of steamed food such as dumpling or heating of food made of various materials that is likely to be heated unevenly such as frozen TV dinner.

Herein, speaking briefly about superheated steam, the superheated seam refers to steam higher than the saturation temperature at a certain pressure, and for example, at ordinary pressure (one atmospheric pressure), it refers to steam higher than 100° C. When the object containing moisture such as food is heated by such superheated steam, until the temperature of the superheated steam drops below 100° C., it maintains the capacity of evaporating the moisture from the object, and does not damp the object if a dry object is heated. It also has a high heat energy, and heat is exchanged effectively on the surface of the object. In the industrial field, the superheated steam has recently come to be used as the drying means in the food processing field.

On the other hand, microwave heating is known to heat the object from both inside and outside simultaneously as the microwaves penetrate deeply into the object. However, the heating chamber is a kind of hollow resonator for microwaves, and standing waves are formed, and strong electric field and weak electric field appear alternately in a flat heating pattern. This is the cause of uneven heating characteristic of microwave oven.

It is the invention that takes note of the huge thermal energy of superheated steam and notices its nature of not wetting the object. That is, according to the heating pattern in FIG. 3 (*a*), the superheated steam quickly encloses the frozen TV dinner and begins to thaw the surface uniformly. On the other hand, the microwave has the nature of entering from four corners of the food, hardly getting into the center, and therefore when the microwave alone is used, first four corners are melted, and once melted, since water has a dielectric loss of more than thousand times that of ice, the microwave is concentrated in this area. In the invention, utilizing the superheated steam, too, the central ice portion of the frozen food is thawed simultaneously with four corners. Once beginning to thaw, concentration of microwaves in the corners is lessened.

This effect is also obtained in the ordinary saturated vapor. But, by using saturated vapor, dew is condensed immediately on the surface of the frozen food, and the surface is wetted as the heating proceeds. A slight moisture may improve the finish in the case of dumpling or hamburger, but it is a problem in grilled fish. It is a fatal defect if water from dew condensation drops on cooked rice. By the superheated steam, since the moisture contained in the food is boiled instantly, the surface is not wetted, and the cooking finish is dramatically improved in this respect.

(Embodiment 2)

In (b) is shown an example of changing the steam temperature while heating in the heating chamber, and the first half is a medium moisture state at around 60° C. and the second half is rapidly changed to superheated steam of 120° C. At the same time, the microwave is decreased gradually. It was particularly effective in heating of food desired to finish with a crisp surface, such as frozen bread and fried food. That is, while preventing drying of food with a thin steam below the saturation temperature in the first half, uneven heating by microwave is slightly lessened, and the surface is dried at once by the superheated steam in the second half.

The steam temperature in the second half can be optimally selected according to the food. Favorable results were obtained at around 60° C. in the frozen bread, and slightly higher around 80° C. in the fried food. To warm steamed food such as dumpling and meat pie, favorable results were obtained by absorbing moisture sufficiently in the food with the saturated vapor at 100° C.

(Embodiment 3)

Figure 4:
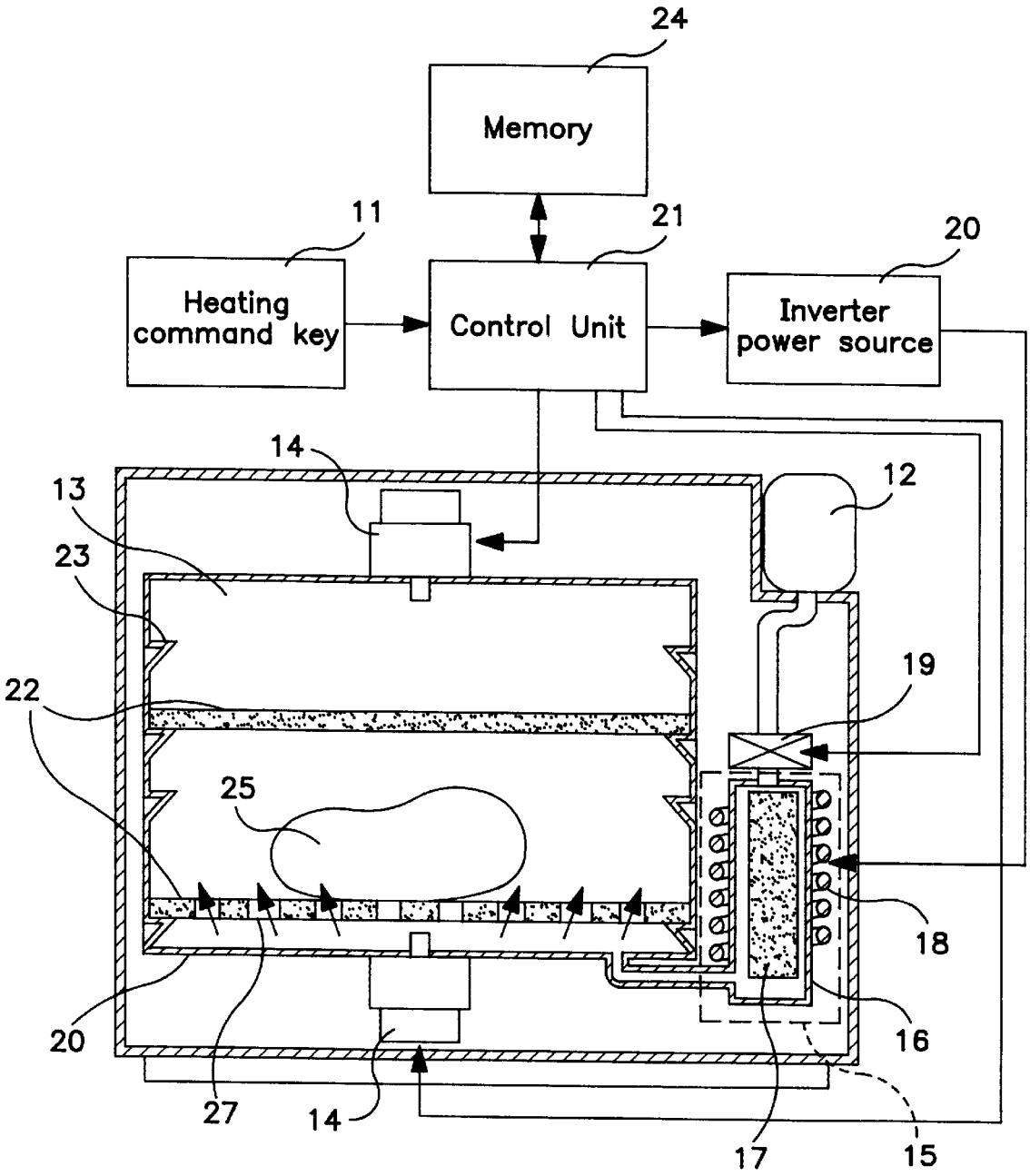
FIG. 4 is a front sectional view of a heating chamber showing a different embodiment of the invention.
Figure 5:
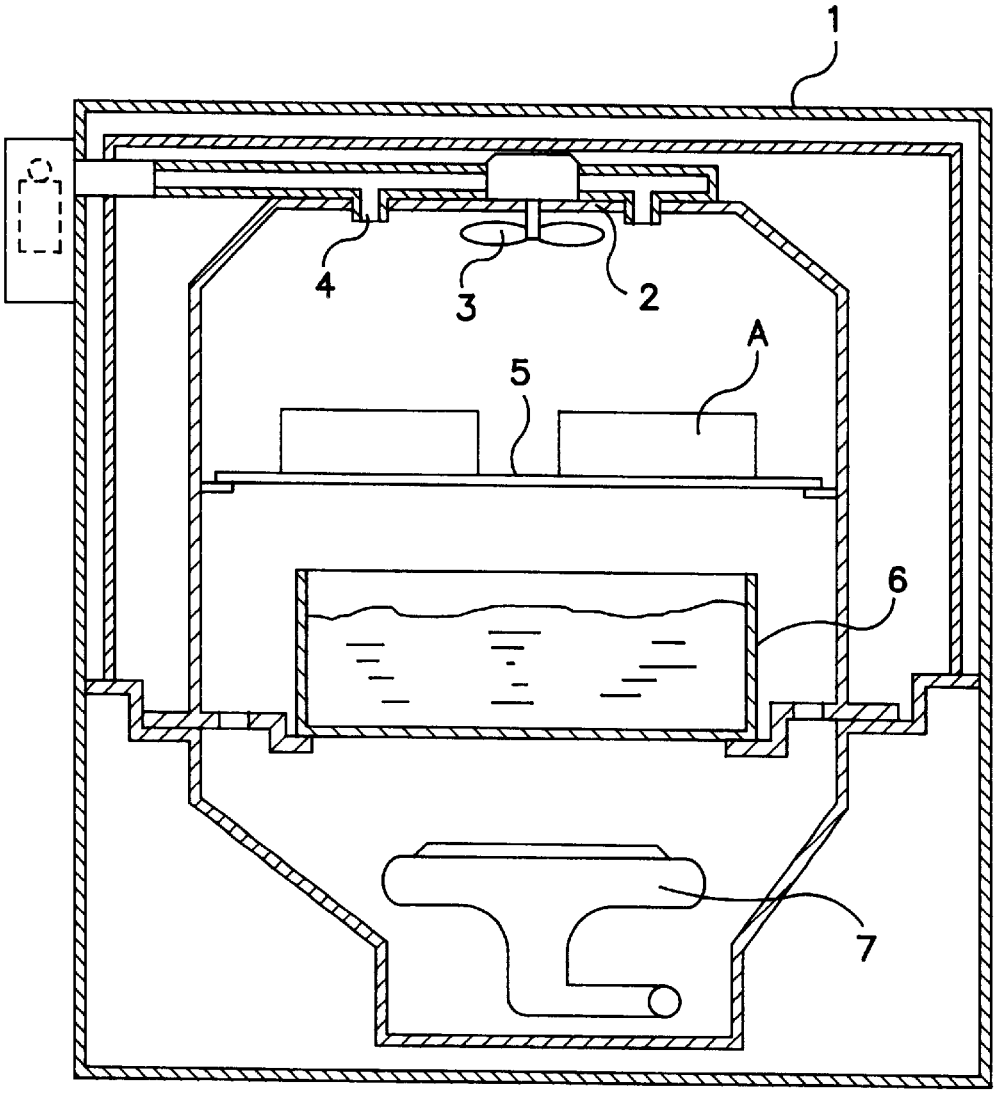
FIG. 5 is a front sectional view of a heating chamber of a conventional food thawing type cooking oven.

FIG. 4 is a front sectional view of a heating chamber showing a different embodiment, in which the magnetron 14 is disposed at both ceiling and bottom of the heating chamber. This top-bottom power feeding is a practical technology widely employed in professional microwave oven, and a high output is obtained while maintaining a favorable electric field distribution. The object to be heated 25 is put directly on the bottom heating partition wall 22, not on the tray. Penetration holes 27 are formed in the bottom heating partition wall, and the superheated steam from the steam generator 15 is discharged to the bottom of the heating chamber 13.

In such constitution, the bottom heating partition wall 22 absorbs microwaves to rise in temperature, and the heat is directly transmitted to the object, so that the heating efficiency is excellent. Besides, the superheated steam is once discharged to the bottom of the heating chamber, when taking out the object by opening the door after heating, the user is not exposed to high temperature superheated steam discharged by mistake. The superheated steam introduced into the heating chamber passes through the penetration holes 27 in the heating partition wall 22, and the heat is effectively given, and lowering of temperature is prevented.

The heating partition wall as the superheated steam maintaining means is provided in both upper and lower parts of the heating chambers in both embodiments in FIG. 1 and FIG. 3, but it may be provided in the upper side of the heating chamber alone, or in the lower side of the heating chamber alone. Anyway, as far as a sufficient heat is applied to the superheated steam introduced into the heating chamber, it may be supplied from one direction only, or from the side wall or rear wall. It may be also considered to form heating partition walls on five sides except for the door, or the door may be also formed as heating partition wall by furnishing with an inspection window.

In the embodiments, without using sensor or detecting means, according to the heating method entered from the input means, heating is carried out according to the heating condition predetermined in the memory means, but it may be also realized by using detecting means for measuring the environments in the heating chamber, and feeding back the current to the steam generator. Such detecting means may include temperature detecting means or humidity detecting means.

The steam generator is not limited to the illustrated example in the embodiments, but any means may be used as far as superheated steam can be generated. For example, an ultrasonic vibrator may be provided in the boiler, and fine water drops are formed for heating the heat source, thereby generating superheated steam.

As explained herein, the invention brings about the following effects.

(1) By heating the object placed in the heating chamber while irradiating with microwaves in superheated steam, the object can be heated efficiently from both inside and outside without wetting its surface.

(2) By changing over and using either the superheated steam or saturated vapor depending on the type of the food, or by changing over and using superheated steam and steam below saturation temperature during heating, optimum heating for the food can be done efficiently.

(3) By using superheated steam at least in a certain period during heating, the crust of bread or fried food can be dried intentionally.

(4) Superheated steam can be generated easily.

(5) By the superheated steam maintaining means, the superheated steam supplied into the heating chamber is prevented from lowering below the saturation temperature, so that the superheated steam remains as it is.

(6) The partition wall of porous material such as ceramic or fibers of paper or cloth for absorbing part of superheated steam prevents dew condensation on the wall by steam, and re-evaporates the moisture absorbed by microwaves, and lowers the steam volume and temperature in the heating chamber (7) The partition wall made of water repellent dielectric material does not absorb superheated moisture, but absorbs microwaves to rise in temperature, and exhibits a hot plate effect to prevent decline of temperature of superheated steam.

(8) The partition wall coated or molded with radio wave absorbing material such as ferrite, or the electric heat source provided in the heating chamber also exhibits a hot plate effect to prevent decline of temperature of superheated steam.

(9) The superheated steam can be effectively utilized depending on the food. The superheated steam maintaining means provided at least at the upper side of the heating chamber prevents dew condensation on the ceiling by the superheated steam guided into the heating chamber and dew drops on the food, thereby preventing drop of quality of the food.

(10) The superheated steam maintaining means provided at least at the lower side of the heating chamber, by putting the food directly on this superheated steam maintaining means, conducts the absorbed thermal energy effectively to the food as hot plate, which improves uneven heating due to presence of standing waves characteristic of microwaves.

(11) By disposing the superheated steam maintaining means at proper position in the heating chamber by detaching and attaching depending on the kind, shape and amount of food, the space to be filled with saturated steam is varied freely, so that heating can be done efficiently in a short time.

(12) The superheated steam maintaining means having penetration holes provided at least at the lower side of the heating chamber applies heat to the guided superheated steam while passing through the holes, thereby re-evaporating and returning to superheated steam.

INDUSTRIAL APPLICABILITY

According to the invention, as described herein, since the object such as the food is enclosed by superheated steam, and various foods can be favorably heated by microwaves, so that a wide variety of foods can be heated favorably. That is, according to the microwave heating apparatus of the invention, the food can be heated while emitting microwaves in superheated steam, and the food can be heated efficiently from inside and outside without wetting its surface. Depending on the type of the food, superheated steam or saturated vapor can be changed over and used, or during heating, superheated steam and steam below saturation temperature can be changed over and used, so that optimum heating suited to the food can be done efficiently. Moreover, by using superheated steam at least in a certain period during heating, the food can be dried intentionally.

Types of food to which the invention is applicable include frozen TV dinner, frozen bread, frozen fried food, and other food materials that were hard to thaw and reheat by the conventional microwave heating.

Not limited to foods, it may be also applied to various materials having a wide range of dielectric loss. For example, it can be applied in melting of synthetic resin, softening of adhesive, drying of wood, and other materials demanding delicate heating used in wide industrial fields.

As the heat source, aside from microwave ovens, an alternating electric field of high frequency and others are also usable.

What is claimed is:

1. A microwave heating apparatus comprising a heating chamber for accommodating an object to be heated, steam generating means for supplying superheated steam having temperature of more than 100° C. to the heating chamber, superheated steam maintaining means for preventing the temperature of the superheated steam from decreasing in the heating chamber, said maintaining means composed of a wall surface of the heating chamber capable of absorbing moisture, and microwave generating means for irradiating the object with microwaves.

2. A microwave heating apparatus of claim 1, wherein the object is placed in the heating chamber, and the microwaves are emitted to the object while the superheated steam is being supplied into the heating chamber.

3. A microwave heating apparatus of claim 1, wherein the steam generating means supplies, in addition to the superheated steam, further at least one of saturated vapor and steam at temperature below the saturated vapor to the heating chamber.

4. A microwave heating apparatus of claim 3, wherein the steam generating means has a function of controlling the temperature of superheated steam, saturated vapor, and steam at temperature of less than the saturated vapor.

5. A microwave heating apparatus of claim 3, wherein the steam generating means has a function of supplying one of superheated steam, saturated vapor, and steam at temperature of less than the saturated vapor to the heating chamber depending on the kind of the object.

6. A microwave heating apparatus of claim 1, wherein the superheated steam is supplied into the heating chamber, and the object is dried by the superheated steam.

7. A microwave heating apparatus of claim 1, wherein the steam generating means has heat source and water, and by dropping water onto the heat source, the superheated steam is generated.

8. A microwave heating apparatus of claim 1, wherein the object is put in the heating chamber, and the object is irradiated with the microwaves while the superheated steam is being supplied into the heating chamber so as to prevent decline of temperature of the superheated steam.

9. A microwave heating apparatus of claim 1, wherein the steam generating means supplies, in addition to the superheated steam, further at least one of saturated vapor and steam at temperature below the saturated vapor to the heating chamber.

10. A microwave heating apparatus of claim 1, wherein the wall surface is formed of porous ceramics or inorganic material.

11. A microwave heating apparatus of claim 1, wherein the wall surface is formed of fibers.

12. A microwave heating apparatus of claim 1, wherein the superheated steam maintaining means is composed of an electric heat source provided in the heating chamber, and lowering of temperature of the superheated steam is prevented by the hot plate effect of the heat source.

13. A microwave heating apparatus of claim 1, wherein the superheated steam maintaining means is disposed at least one of near an upper side and near a lower side of the heating chamber.

14. A microwave heating apparatus of claim 1, wherein the superheated steam maintaining means is disposed at least near a lower side of the heating chamber, and the object is directly put on the superheated steam maintaining means.

15. A microwave heating apparatus of claim 1, wherein the superheated steam maintaining means includes detachably formed partition walls provided at plural positions in the heating chamber, and the position of the partition walls can be adjusted depending on the type of the object.

16. The microwave heating apparatus of claim 15, wherein the partition walls include a surface capable of one of absorbing moisture and generating heat by the microwaves.

17. A microwave heating apparatus of claim 1, wherein the superheated steam maintaining means includes a partition wall disposed at least near the lower side of the heating chamber, and the partition wall has holes for passing the superheated steam, the object is placed at an upper position of the partition wall, and the superheated steam from the steam generating means is supplied to the lower side of the partition wall.

18. The microwave heating apparatus of claim 17, wherein the partition walls include a surface capable of one of absorbing moisture and generating heat by the microwaves.

19. A microwave heating apparatus comprising a heating chamber for accommodating an object to be heated, steam generating means for supplying superheated steam having temperature of more than 100° C. to the heating chamber, superheated steam maintaining means for preventing the temperature of the superheated steam from decreasing in the heating chamber, said maintaining means composed of a wall surface of the heating chamber capable of generating heat by the microwaves, and microwave generating means for irradiating the object with microwaves.

20. A microwave heating apparatus of claim 19, wherein the wall surface contains a water repellent dielectric material.

21. A microwave heating apparatus of claim 19, wherein the wall surface contains a radio wave absorbing material.

22. The microwave heating apparatus of claim 19, wherein the superheated steam maintaining means includes detachably formed partition walls provided at plural positions in the heating chamber, the partition walls having a surface capable of absorbing moisture, and the position of the partition walls can be adjusted depending on the type of the object.

23. The microwave heating apparatus of claim 19, wherein the superheated steam maintaining means includes detachably formed partition walls provided at plural positions in the heating chamber, the partition walls having a surface capable of generating heat by the microwaves, and the position of the partition walls can be adjusted depending on the type of the object.

24. A microwave heating method for heating an object, comprising the steps of;

(1) putting the object in a heating chamber included within a microwave heating apparatus further comprising steam generating means for supplying superheated steam having temperature of more than 100° C. to the heating chamber, superheated steam maintaining means for preventing the temperature of the superheated steam from decreasing in the heating chamber, said maintaining means composed of a wall surface of the heating chamber capable of absorbing moisture, and microwave generating means for irradiating the object with microwaves, (2) irradiating the object with the microwaves, and (3) supplying superheated steam having temperature more than 100° C. to the heating chamber.

25. A microwave heating method of claim 24, further comprising the step (4) of irradiating the object with microwaves, while simultaneously supplying at least one of saturated vapor and steam at less than the temperature of saturated vapor to the heating chamber.

26. A microwave heating method of claim 25, wherein the superheated steam and at least one of saturated vapor and steam at less than the temperature of saturated vapor are mutually changed over and supplied into the heating chamber.

27. A microwave heating method of claim 24, wherein the superheated steam is reheated in the heating chamber, and the microwaves are emitted to the object while maintaining the temperature of the superheated steam.

28. A microwave heating method of claim 24, further comprising the step (4) of preventing the temperature of the superheated steam supplied in the heating chamber from lowering, by the superheated steam maintaining means provided in the heating chamber.

29. A microwave heating method of claim 28, wherein the wall surface of the superheated steam maintaining means is a wall surface of an adjustable partition wall, the superheated steam supplied in the heating chamber is absorbed in the partition wall, and the absorbed superheated steam is heated again by the microwaves.

30. A microwave heating method of claim 29, wherein the partition wall is composed of porous material, and the moisture in the superheated steam is absorbed in the porous material.

31. A microwave heating method of claim 28, wherein the wall surface of the superheated steam maintaining means is a wall surface of an adjustable partition wall capable of generating heat by the microwaves, and the superheated steam supplied in the heating chamber is heated again by the partition wall generating heat.

32. A microwave heating method of claim 31, wherein the partition wall contains at least one of dielectric material and radio wave absorbing material.

33. A microwave heating method of claim 28, wherein the superheated steam maintaining means has a partition wall disposed at least near the lower end of the heating chamber, the partition wall has holes for passing the superheated steam, the object is put at an upward position of the partition wall, the superheated steam is supplied to the lower side of the partition wall, and the superheated steam supplied to the lower side of the partition wall is supplied to the object through the holes.

34. A microwave heating method of claim 24, wherein the superheated steam dries the object without wetting its surface.

35. A microwave heating method of claim 24, wherein the superheated steam is supplied near the surface of the object in the state of the microwaves being emitted to the object.

36. A microwave heating method of claim 24, wherein the superheated steam is generated by dropping water onto a heat source.

* * * * *

UNITED STATES PATENT AND TRADEMARK OFFICE

CERTIFICATE OF CORRECTION

PATENT NO. : 6,040,564
DATED : March 21, 2000
INVENTOR(S) : Ueda et al

It is certified that error appears in the above-identified patent and that said Letters Patent is hereby corrected as shown below:

Title page, item [73], Assignee, "Matsushita Electric Industrial Co.,Ltd."
should be -- Matsushita Electric Industrial Co., Ltd
-- U.S. Patent Documents

| | | |
|---|---|---|
| 3,889,009 | 6/1975 | Lipoma |
| 5,525,782 | 6/1996 | Yoneno et al. |
| 3,814,901 | 6/1974 | Morhack |
| 5,215,000 | 6/1993 | Desage et al. -- |

Title page item [56],
Foreign Patent Document
-- 55- 49631 4/1980 Japan --

Signed and Sealed this

Fourth Day of September, 2001

*Attest:*

Nicholas P. Godici

*Attesting Officer*

NICHOLAS P. GODICI
*Acting Director of the United States Patent and Trademark Office*